US011850528B2

(12) United States Patent
Jiang

(10) Patent No.: US 11,850,528 B2
(45) Date of Patent: Dec. 26, 2023

(54) MAGIC CUBE WITH VISIBLE MAGNETIC CABINS

(71) Applicant: GAN CUBE INC., Foshan (CN)

(72) Inventor: Ganyuan Jiang, Foshan (CN)

(73) Assignee: GAN CUBE INC., Foshan (CN)

( * ) Notice: Subject to any disclaimer, the term of this patent is extended or adjusted under 35 U.S.C. 154(b) by 0 days.

(21) Appl. No.: 17/851,059

(22) Filed: Jun. 28, 2022

(65) Prior Publication Data

US 2023/0321525 A1 Oct. 12, 2023

(30) Foreign Application Priority Data

Apr. 7, 2022 (CN) ..... 202220802196.6

(51) Int. Cl.
*A63F 9/08* (2006.01)

(52) U.S. Cl.
CPC ..... *A63F 9/0842* (2013.01)

(58) Field of Classification Search
CPC ..... A63F 9/0842; A63F 9/0826
See application file for complete search history.

(56) References Cited

U.S. PATENT DOCUMENTS

| | | | | |
|---|---|---|---|---|
| 11,484,780 | B1 * | 11/2022 | Jiang | A63F 9/34 |
| 2020/0023266 | A1 * | 1/2020 | Lee | A63F 9/0842 |
| 2022/0118354 | A1 * | 4/2022 | Osipov | A63F 9/0842 |

FOREIGN PATENT DOCUMENTS

| | | | | |
|---|---|---|---|---|
| CN | 108568089 | A * | 9/2018 | A63F 9/0842 |
| CN | 111494930 | A * | 8/2020 | A63F 9/0842 |
| CN | 212141429 | U * | 12/2020 | |
| CN | 212804488 | U * | 3/2021 | |
| CN | 213077452 | U * | 4/2021 | |
| WO | WO-2014094051 | A1 * | 6/2014 | A63F 9/0602 |
| WO | WO-2022001522 | A1 * | 1/2022 | |
| WO | WO-2022001528 | A1 * | 1/2022 | |
| WO | WO-2022001529 | A1 * | 1/2022 | |

* cited by examiner

*Primary Examiner* — Steven B Wong

(57) ABSTRACT

A magic cube with visible magnetic cabins includes a central shaft piece, six central blocks, eight corner blocks, and twelve edge blocks. Corner block magnetic cabins and edge block magnetic cabins are respectively arranged on the corner blocks and the edge blocks. Magnets and magnetic pieces are respectively arranged in the corner block magnetic cabins and the edge block magnetic cabins. Elastic force between the central blocks and the central shaft piece is adjusted by gear adjusting pieces arranged in the central blocks. By arranging the corner block and edge block magnetic cabins, stability of installation positions of the magnets and magnetic pieces is ensured and an assembly accuracy is improved. The magnetic pieces do not fall off or offset during use. By arranging the gear adjusting pieces in the central blocks, it is convenient to quickly adjust elastic force between the central blocks and the central shaft piece.

11 Claims, 15 Drawing Sheets

MAGIC CUBE WITH VISIBLE MAGNETIC CABINS

TECHNICAL FIELD

The present disclosure relates to a technical field of magic cube technology, and in particular to a magic cube with visible magnetic cabins.

BACKGROUND

A conventional magic cube is a 6-sided cube made of elastic hard plastic. The conventional magic cube comprises a core shaft and 26 blocks. The 26 blocks comprise six central blocks, 8 corner blocks and 12 edge blocks. The six central blocks, are fixed and only one side of each central blocks is colored. The eight corner blocks are rotatable and the 12 edge blocks are rotatable. When the magic cube is on sale, the blocks are arranged so that blocks on s same side of the magic cube have a same color. When the blocks one side of the magic cube are rotated, the single color of adjacent sides is destroyed, and the blocks of the magic cube form a new pattern. The pattern are changed again and again by rotating the blocks, so that each side of the magic cube is made up of blocks of different colors. The gameplay is to restore the disrupted blocks to have a single color on each side as soon as possible by rotating the blocks.

Since advent of the magic cube, it was once popular all over the world due to its strong educational function for human beings. The magic cube is easy to understand, ever-changing, and highly flexible. In order to play it well, players must be able to concentrate, think constantly, and do not be in a hurry to gradually play well. In a sense, the magic cube has become a special intellectual development toy and a toy for assessing level and maturity of players' intelligence, thus attracting batches of players.

In a magic cube competition, complex magic cubes are usually used as competition props. During the competition, contestants need to rotate the magic cubes quickly to complete reordering of the magic cube in the shortest time. The conventional magic cube relies on precise rotation by the contestants and the conventional magic cube needs to rotated 90 degree every time, so that the magic cube is not easy to get stuck. However, a magic cube with magnetic positioning blocks has a magnetic attraction to make the magic cube to automatically correct position in a close-to-90-degree shape, making positioning of the blocks accurate.

However, an existing magnetic cube has following defects.

An elasticity of central blocks of some existing magnetic cubes is not adjustable, which are unable to adapt to different needs of players. If there are different elastic requirements for the magnetic cube, a whole iron shaft screw should be unscrewed to replace different springs, which is very troublesome to adjust. Further, extra accessories are added. There are also some magnetic cubes that change the elasticity of the central blocks of the magnetic cube by adjusting a depth of screws. Adjusting the elastic force of the central blocks requires the help of tools, which is very troublesome to adjust. Further, there is no visible gear mark on the central blocks, so the players are unable to accurately adjust the central blocks to desired elastic force positions, and the user experience is poor.

In the existing magnetic cubes, magnets of the corner blocks and edge blocks are adhered to inner walls of the corner blocks and edge blocks by glue. In actual assembly, the entire magnetic cube needs to be disassembled, and the magnets are pasted on the inner walls of the corner blocks and edge blocks by chemical substances such as the glue. Assembly positions of the magnets are uncontrollable, and use of the glue is not environmentally friendly, but also has poor assembly accuracy, and the magnets are easily dropped from the inner walls during high-speed rotation. Moreover, the magnets in the corner blocks and the edge blocks are invisible. During normal use, the players are unable to see the magnets, and unable to determine whether the magnets are assembled in correct positions and whether the magnets are falling off the inner walls of the corner blocks and the edge blocks.

SUMMARY

In view of defects in the prior art, the present disclosure proposes a double-mode double-tuned magic cube with visible magnetic cabins. By arranging special magnetic cabins in corner blocks and edge blocks, stability of installation positions of the magnetic pieces is ensured and an assembly accuracy is improved. Further, the magnetic piece will not fall off or offset during use. Further, by arranging special gear adjusting pieces in the central blocks, it is convenient to quickly adjust elastic force between the central blocks and a central shaft piece.

In order to realize above technical solutions, the present disclosure provided a magic cube with visible magnetic cabins. The magic cube with visible magnetic cabins comprises a central shaft piece, six central blocks, eight corner blocks, and twelve edge blocks.

The six central blocks are separately connected with an end shaft of the central shaft piece. Each of the central blocks is movably connected with adjacent corners blocks and adjacent edge blocks through corner block feet arranged on the corner blocks and engaging feet arranged on the edge blocks. The central shaft piece is spliced with the six central blocks, the eight corner blocks, and the twelve edge blocks to form a regular hexahedron. Corner block magnetic cabins are arranged on inner sides of the corner blocks and edge block magnetic cabins are arranged on inner sides of the edge blocks. A magnet is arranged in each of the corner block magnetic cabins. A magnet piece is arranged in each of the edge block magnetic cabins. Elastic force between the six central blocks and the central shaft piece is adjusted by a gear adjusting piece arranged in each of the central blocks.

Optionally, each of the central blocks comprises a top cover, a gear adjusting seat, the gear adjusting piece, an elastic adjusting screw, and a pressure adjusting spring. Each top cover covers a top portion of a corresponding gear adjusting seat. Each gear adjusting piece is arranged above a corresponding gear adjusting seat. A bottom portion of each elastic adjusting screw vertically pass through a corresponding gear adjusting piece and a corresponding gear adjusting seat and is connected with the central shaft piece. Each pressure adjusting spring is sleeved between a corresponding elastic adjusting screw and a corresponding gear adjusting piece.

Optionally, each gear adjusting seat comprises an adjusting seat body, a central column is arranged in a center of each adjusting seat body. A central hole penetrating each central column is on a center of each central column. A sawtooth gear block is arranged on a periphery of each central column. A gear indicating ring is arranged on a periphery of each sawtooth gear block. Gear numbers corresponding to each sawtooth gear block are on each gear indicating ring.

Optionally, each gear adjusting piece comprises an adjusting piece body. A sawtooth adjusting portion is arranged on a bottom potion of each adjusting piece body. Each sawtooth adjusting portion is engaged with a corresponding sawtooth gear block of a corresponding gear adjusting seat. Two gear adjusting dials upwardly protruded are symmetrically arranged on a top portion of each adjusting piece body. A gear indicating arrow configured to indicate a gear is arranged on the top portion of each adjusting piece body. Each gear indicating arrow is arranged between each two gear adjusting dials.

Optionally, each top cover is arranged on a top portion of each gear adjusting seat. Each top cover is openable and closable. Each top cover comprises a top cover body. A plurality of alignment grooves matched with a corresponding gear adjusting seat are arranged on a bottom portion of each top cover body. A plurality of snapping blocks docking with a corresponding gear adjusting seat are arranged on a side wall of the bottom portion of each top cover body.

Optionally, each of the corner blocks comprises three corner block seats with a same structure and spliced with each other. A magnet fixing device is installed between the three corner block seats of each of the corner blocks. Each magnet fixing device comprises a corner block magnetic cabin assembly and a magnet fixing assembly. Each magnet fixing assembly is stacked and installed in a corresponding corner block magnetic cabin assembly. Each corner block magnetic cabin assembly comprises three corner block magnetic cabins. The three corner block magnetic cabins of each corner block magnetic cabin assembly are respectively clamped at joints of end edges of the three corner block seats of each of the corner blocks. A magnet is installed in each of the corner block magnetic cabins. Each magnet is tightly pressed by a magnet pressing seat correspondingly arranged on a corresponding magnet fixing assembly. The corner block magnetic cabins are transparent visible corner block magnetic cabins.

Optionally, each corner block magnetic cabin assembly comprises a corner block magnetic cabin seat with a shape of an equilateral triangle. Each corner block magnetic cabin seat comprises end corners. Each of the corner block magnetic cabins is arranged on a corresponding end corner. A center of each corner block magnetic cabin seat defines a first central alignment hole. A plurality of clamping holes are on a periphery of each first central alignment hole.

Each magnet fixing assembly comprises a fixing seat body. Each fixing seat body comprises three magnet pressing seats corresponding to the three corner block magnetic cabins of each corner block magnetic cabin assembly. A corner block docking seat is arranged on one side of each of the magnet pressing seats. Each fixing seat body is engaged with the three corner block seats of each corner block through the three corner block docking seats of each fixing eat body. A plurality of clamping posts matched with the clamping holes on each corner block magnetic cabin seat are arranged on a bottom portion of each fixing seat body. Each fixing seat body is docked with each corner block magnetic cabin seat through the clamping holes and the clamping posts.

A center of each fixing seat body defines a second central alignment hole matched with the first central alignment hole of each corner block magnetic cabin seat. A plurality of corner block docking holes are on a periphery of each second central alignment hole and are connected with a corresponding corner block seat.

Each of the corner block seats comprises an outer shell. Each outer shell comprises a splicing alignment seat inwardly protruded. Corner block magnetic cabin grooves are provided on edges of a docking end of each outer shell. Each of the corner block magnetic cabins is received in a corresponding corner block magnetic cabin groove. A corner block foot is integrally formed on a bottom portion of each outer shell.

Optionally, each of the edge block comprises a left half shell of the edge block, a right half shell of the edge block, and an edge block magnetic cabin assembly. Each edge block magnetic cabin assembly is clamped between a corresponding left half shell of the edge block and a corresponding right half shell of the edge block. Each left half shell and a corresponding right half shell of the edge block are symmetrically arranged and are connected with each other. Each edge block magnetic cabin assembly comprises a horizontal strut. Edge block magnetic cabins are arranged on left and right ends of each horizontal strut. A magnetic piece is arranged in each of the edge block magnetic cabins. A transparent end cover is arranged on an outer end side of each of the edge block magnetic cabins. Each transparent end cover is openable.

Optionally, a limit docking block is arranged on a middle portion of each horizontal strut. clipping block are outwardly protruded from front and rear end surfaces of each limit docking block. Each horizontal strut is docked with a corresponding left half shell of the edge block and a corresponding right half shell of the edge block through the clipping blocks arranged on each limit docking block. A structure of each left half shell of the edge block is same as a structure of each right half shell of the edge block. Each left half shell of the edge block and each right half shell of the edge block comprise a shell body. An engaging foot is integrally formed on a bottom portion of each shell body. Engaging foot docking posts and engaging foot docking holes are on inner sides of each shell body. When each left half shell of the edge block is docked with the corresponding right half shell of the edge block, the engaging foot docking posts of each shell body are inserted into corresponding engaging foot docking holes.

Optionally, limit seats matched with the limit docking blocks of each horizontal strut is arranged in each edge block magnetic cabin assembly. The limit docking blocks of each horizontal strut are clamped in the limit seats of each edge block magnetic cabin assembly. Edge block magnetic cabin grooves matched with the edge block magnetic cabins arranged on each horizontal strut are provided on end edges of each shell body. The edge block magnetic cabins are clamped in corresponding edge block magnetic cabin grooves.

In the magic cube with visible magnetic cabins of the present disclosure, by arranging the corner block magnetic cabins and the edge block magnetic cabins in the corner blocks and the edge blocks, stability of installation positions of the magnetic pieces and the magnets is ensured and an assembly accuracy is improved. Further, the magnetic pieces and the magnets will not fall off or offset during use. Further, by arranging the gear adjusting pieces in the central blocks, it is convenient to quickly adjust elastic force between the central blocks and the central shaft piece.

In the magic cube with visible magnetic cabins, by structure design of the corner blocks and by setting one magnet fixing device in each of the corner blocks, stable magnet installation positions for three sides of each of the corner blocks are provided, which improves assembly accuracy of the magnets, and ensures that the magnets will not fall off or offset during use.

In the magic cube with visible magnetic cabins, by structure design of the edge blocks and by arranging one edge block magnetic cabin in each of the edge blocks; stability of installation positions of the magnetic pieces are ensured, assembly accuracy of the magnetic pieces is improved, and the magnetic pieces will not fall off or offset during use. Further, there is no need to paste the magnetic pieces on inner walls of the edge blocks by chemical substances such as glue, which is safe and environmentally friendly.

In the magic cube with visible magnetic cabins, by structure design of the central blocks and by arranging one gear adjusting piece arranged in each of the central blocks. different degrees of elastic compression of each pressure adjustment spring are realized by twisting each gear adjusting piece, which greatly facilitates adjustment of the elastic force. In actual adjustment, by twisting each gear adjusting piece and by cooperation between each gear adjusting piece and the corresponding gear adjusting seat, different degrees of elastic compression of each pressure adjustment spring are realized. By adjusting pressure of each pressure adjusting spring, docking pressure and wheelbase between the corresponding gear adjusting seat and the central shaft piece is adjusted, thereby changing a torque when the magic cube is twisted. The greater the docking pressure between each gear adjusting seat and the central shaft piece, the greater the torque required when the magic cube is twisted, and the smaller the docking pressure between each gear adjusting seat and the central shaft piece, the smaller the torque required when the magic cube is twisted. The user is able to quickly adjust the torque to suit his own preferences, which improves user experience.

1-corner block; 11-corner block seat, 111-outer shell; 112-corner block magnetic cabin groove; 113-splicing alignment seat; 114-magnet fixing piece grooves; 115-corner block foot; 12-magnet fixing device; 121-corner block magnetic cabin assembly; 1211-corner block magnetic cabin seat; 1212-corner block magnetic cabin; 1213-clamping holes; 1214-first central alignment hole; 122-magnet fixing assembly; 1221-fixing seat body; 1223-magnet pressing seat; 1224-clamping post; 1225-corner block docking hole; 1226-second central alignment hole 13-corner block magnet;

2-edge block; 21-left half shell of the edge block; 211-shell body; 212-engaging foot; 213-engaging foot docking column; 214-engaging foot docking hole; 215-first shell docking column; 216-second shell docking column; 217-first shell docking hole; 218-second shell docking hole; 219-limit seat; 2110-edge block magnetic cabin groove; 22-right half shell of the edge block; 23-edge block magnetic cabin assembly; 231-horizontal strut; 232-limit docking block; 233-clipping block; 234-edge block magnetic cabin; 235-end cover; 24-magnetic piece; 3-central block; 31-top cover; 311-top cover body; 312-alignment groove; 313-snapping block; 32-gear adjusting seat; 321-adjusting seat body; 322-central column; 323-sawtooth gear block; 324-gear indicating ring; 325-gear number; 326-hand-locking groove; 34-gear adjusting piece; 341-adjusting piece body; 342-sawtooth adjusting portion; 343-gear adjusting dial; 344-gear indicating arrow; 35-elastic adjusting screw; 36-pressure adjusting spring; 37-gasket; 4-central shaft piece.

DETAILED DESCRIPTION

Technical solutions in the embodiments of the present disclosure will be clearly and completely described below with reference to the accompanying drawings in the embodiments of the present disclosure. Obviously, described embodiments are only a part of the embodiments of the present disclosure, rather than all of the embodiments. All other embodiments obtained by those of ordinary skill in the art without creative work should fall within the protection scope of the present disclosure.

Embodiment: A Magic Cube with Visible Magnetic Cabins

Figure 1:
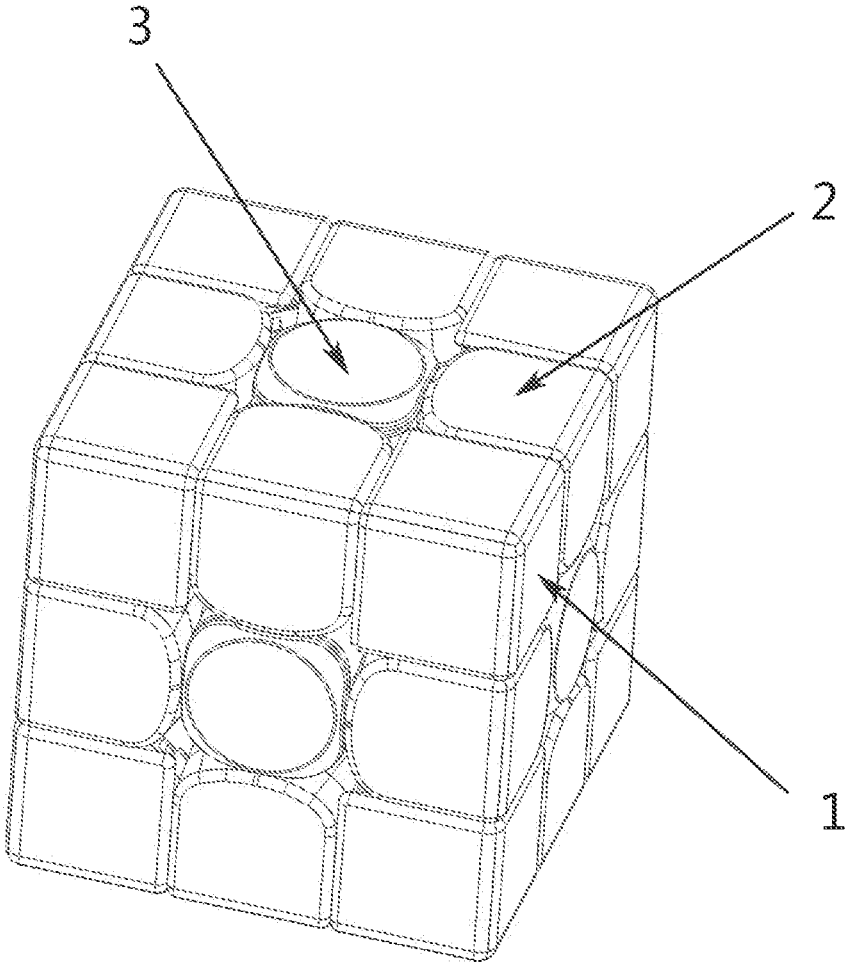
FIG. 1 is a schematic diagram of a magic cube with visible magnetic cabins of the present disclosure.
Figure 2:
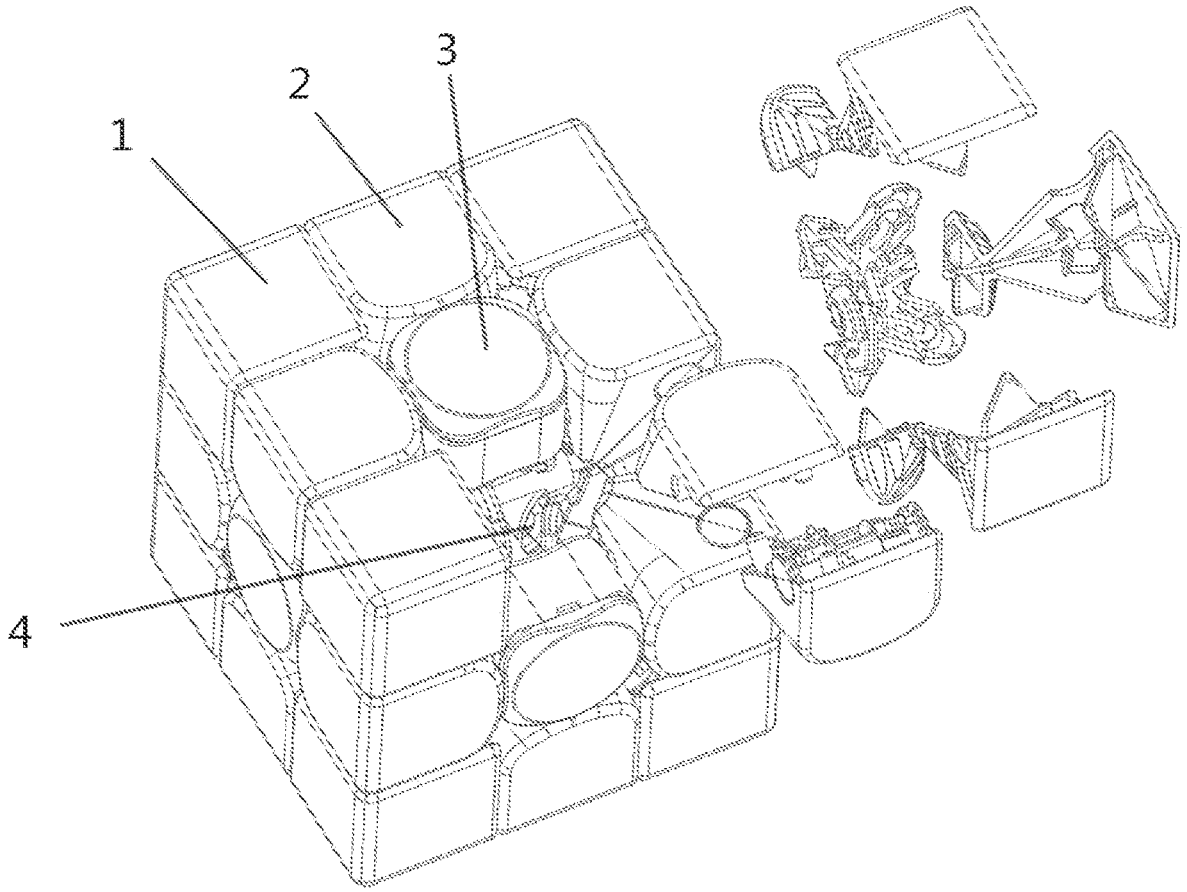
FIG. 2 is an exploded schematic diagram of a magic cube with visible magnetic cabins of the present disclosure.
Figure 3:
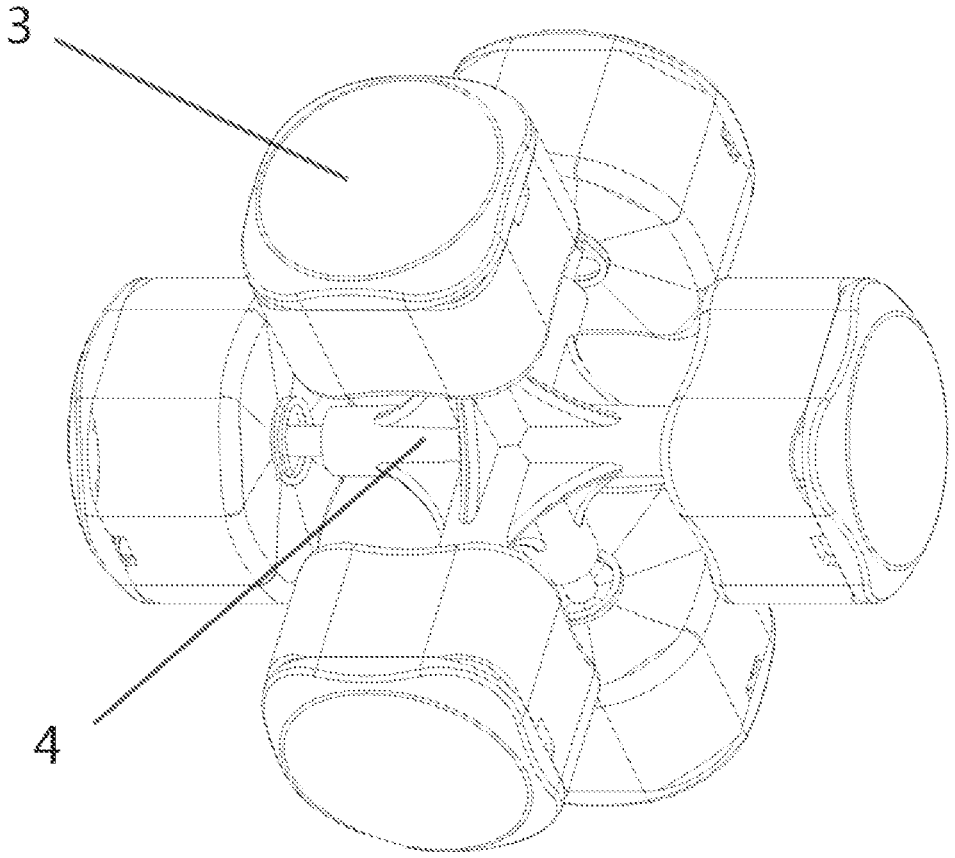
FIG. 3 is an exploded schematic diagram of a central shaft piece and six central blocks of the present disclosure where the central shaft piece is assembled with the six central blocks.

As shown in FIGS. 1-3, the present disclosure provided a magic cube with visible magnetic cabins. The magic cube with visible magnetic cabins comprises a central shaft piece 4, six central blocks 3, eight corner blocks 1, and twelve edge blocks 2. The six central blocks 3 are separately connected with an end shaft of the central shaft piece 4. Each of the central blocks 3 is movably connected with adjacent corners blocks 1 and adjacent edge blocks 2 through corner block feet arranged on the corner blocks and engaging feet arranged on the edge blocks. The central shaft piece 4 is spliced with the six central blocks 3, the eight corner blocks 2, and the twelve edge blocks 1 to form a regular hexahedron.

Figure 4:
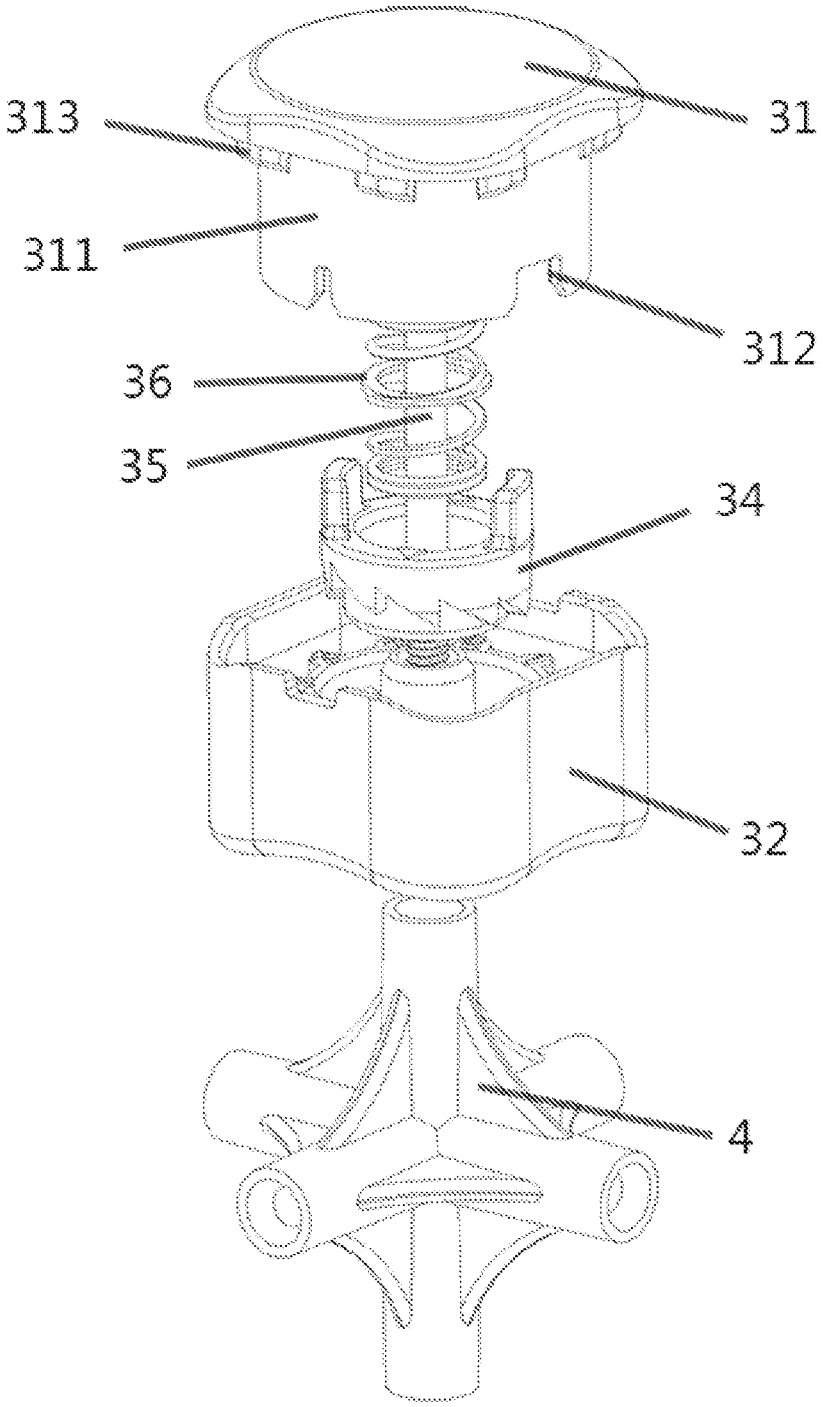
FIG. 4 is an exploded schematic diagram of the central block of the present disclosure.
Figure 5:
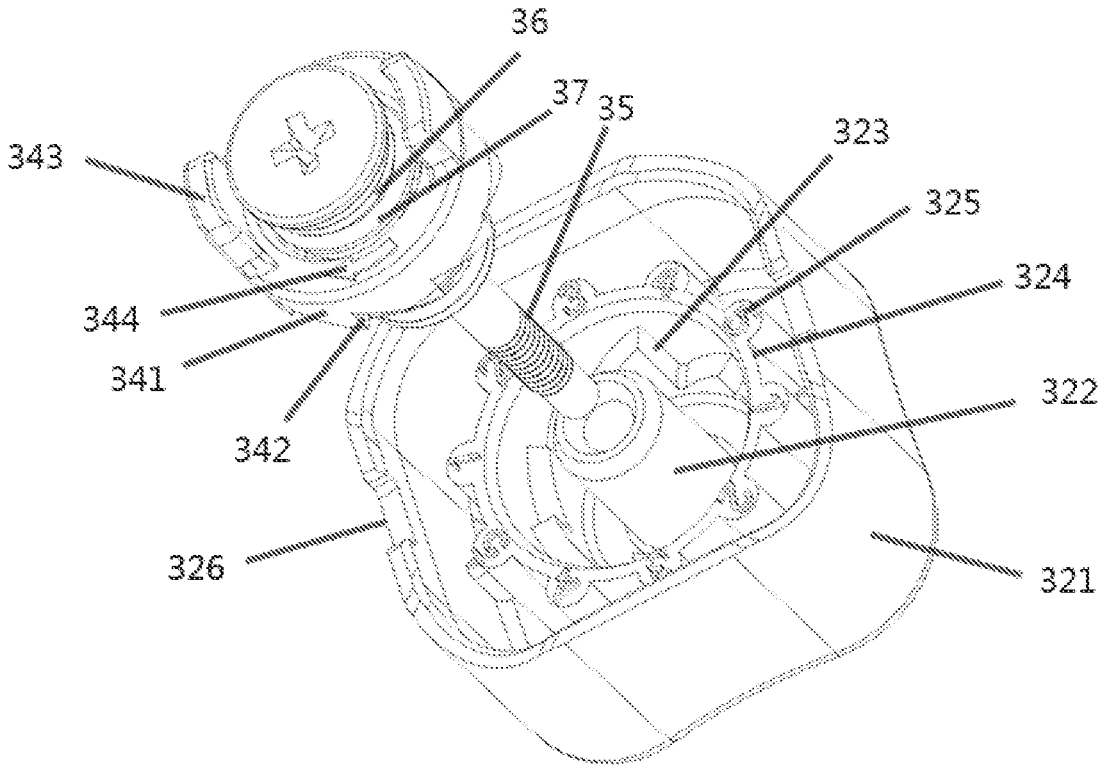
FIG. 5 is an exploded schematic diagram showing an interior of the central block of the present disclosure.
Figure 6:
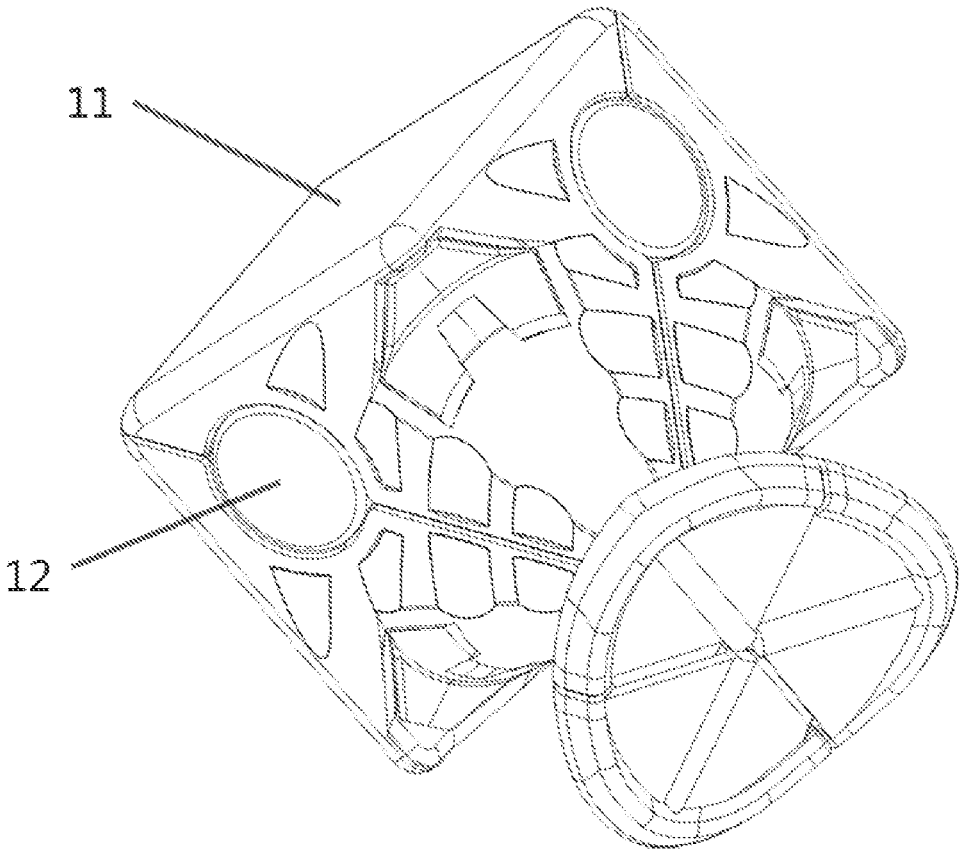
FIG. 6 is a perspective schematic diagram of a corner block of the present disclosure.
Figure 7:
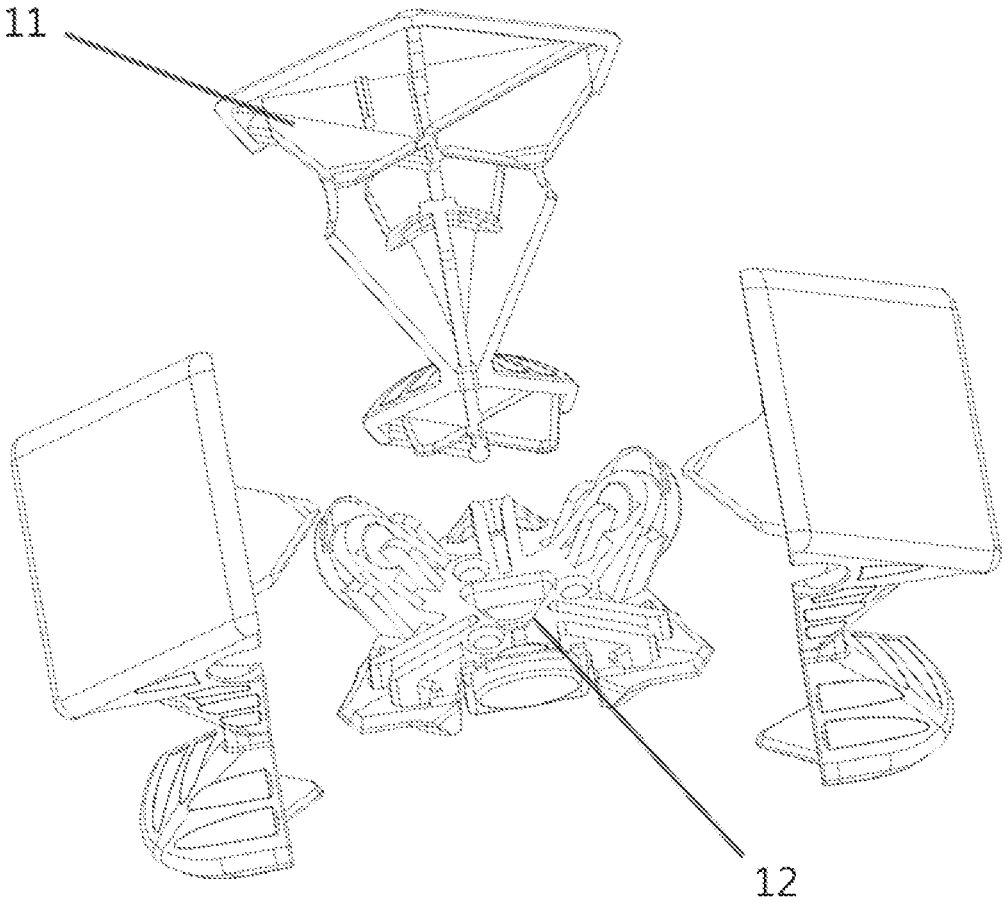
FIG. 7 is an exploded perspective schematic diagram of the corner block of the present disclosure.
Figure 8:
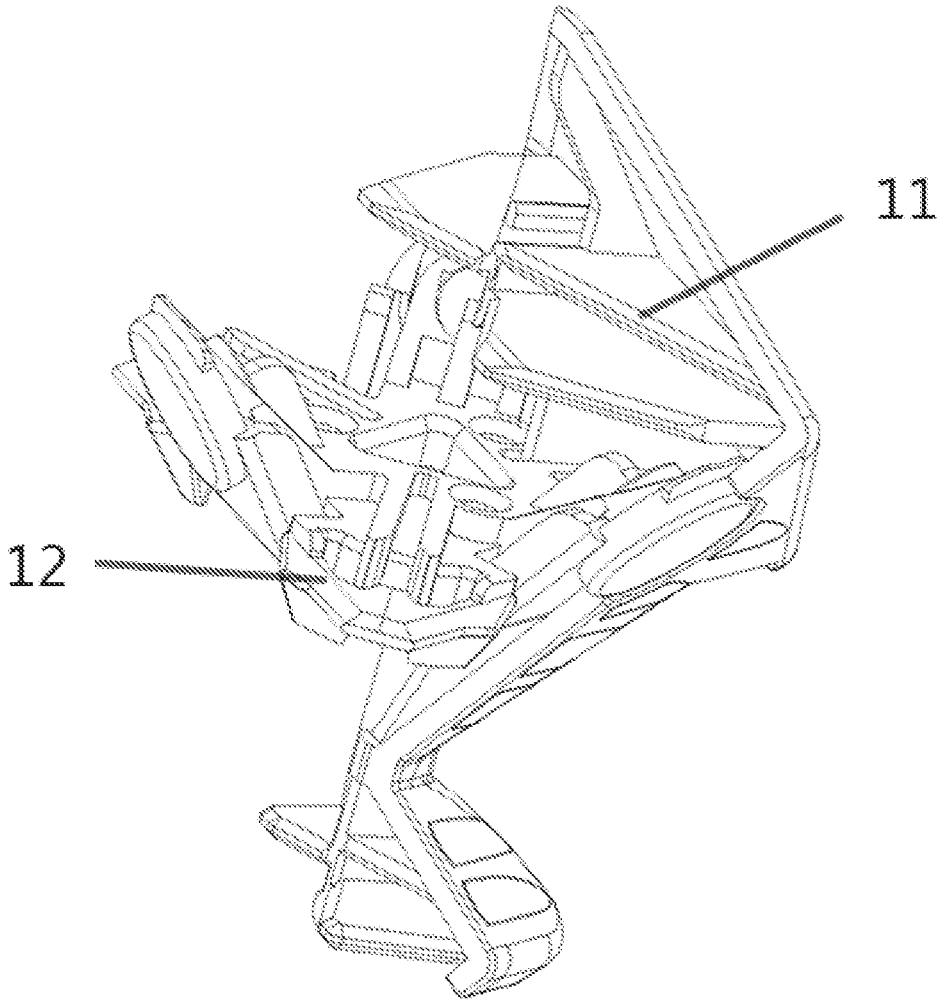
FIG. 8 is an exploded perspective schematic diagram of corner block seats and a magnet fixing device of the corner block of the present disclosure.
Figure 9:
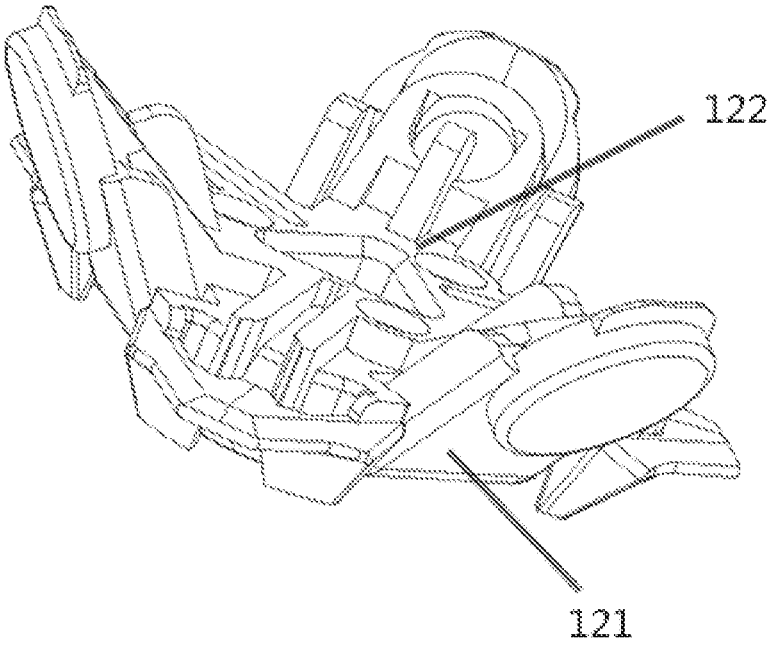
FIG. 9 is a perspective schematic diagram of the magnet fixing device of the present disclosure.
Figure 10:
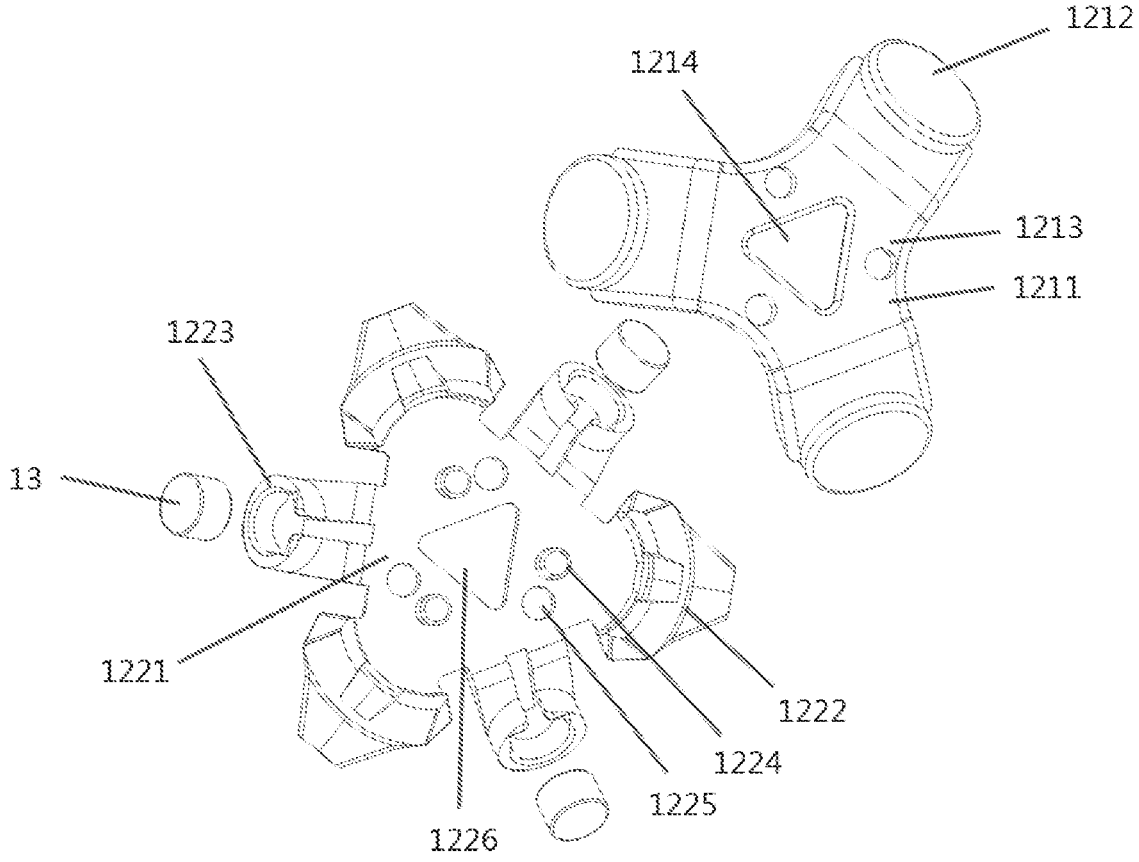
FIG. 10 is an exploded perspective schematic diagram of the magnet fixing device of the present disclosure.
Figure 11:
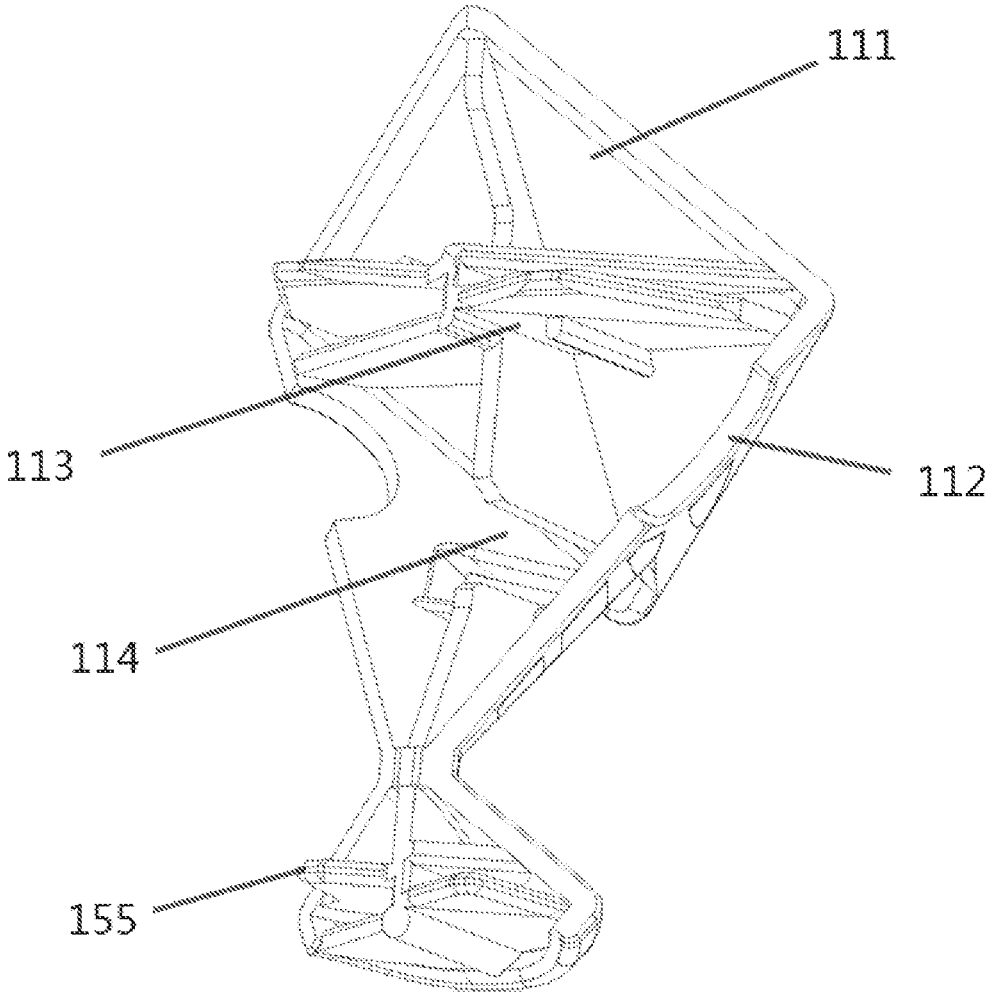
FIG. 11 is an exploded schematic diagram showing an interior of the corner block seat of the present disclosure.
Figure 12:
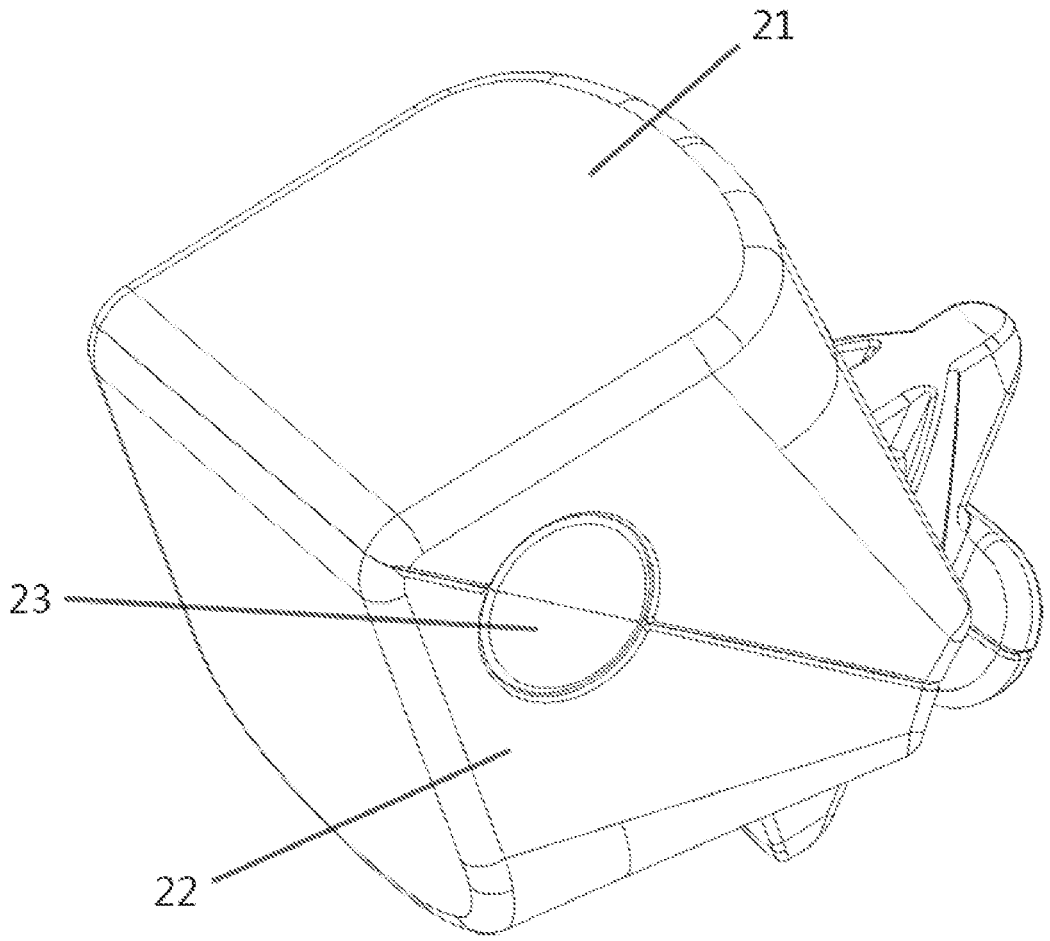
FIG. 12 is a perspective schematic diagram of an edge block of the present disclosure.
Figure 13:
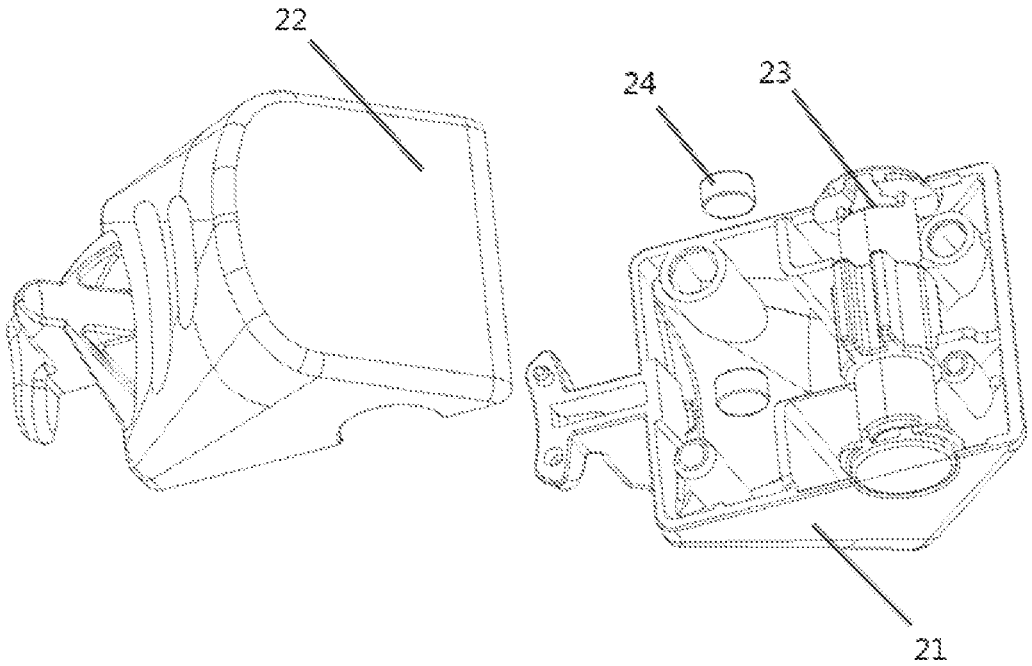
FIG. 13 is an exploded perspective schematic diagram of an edge block of the present disclosure.
Figure 14:
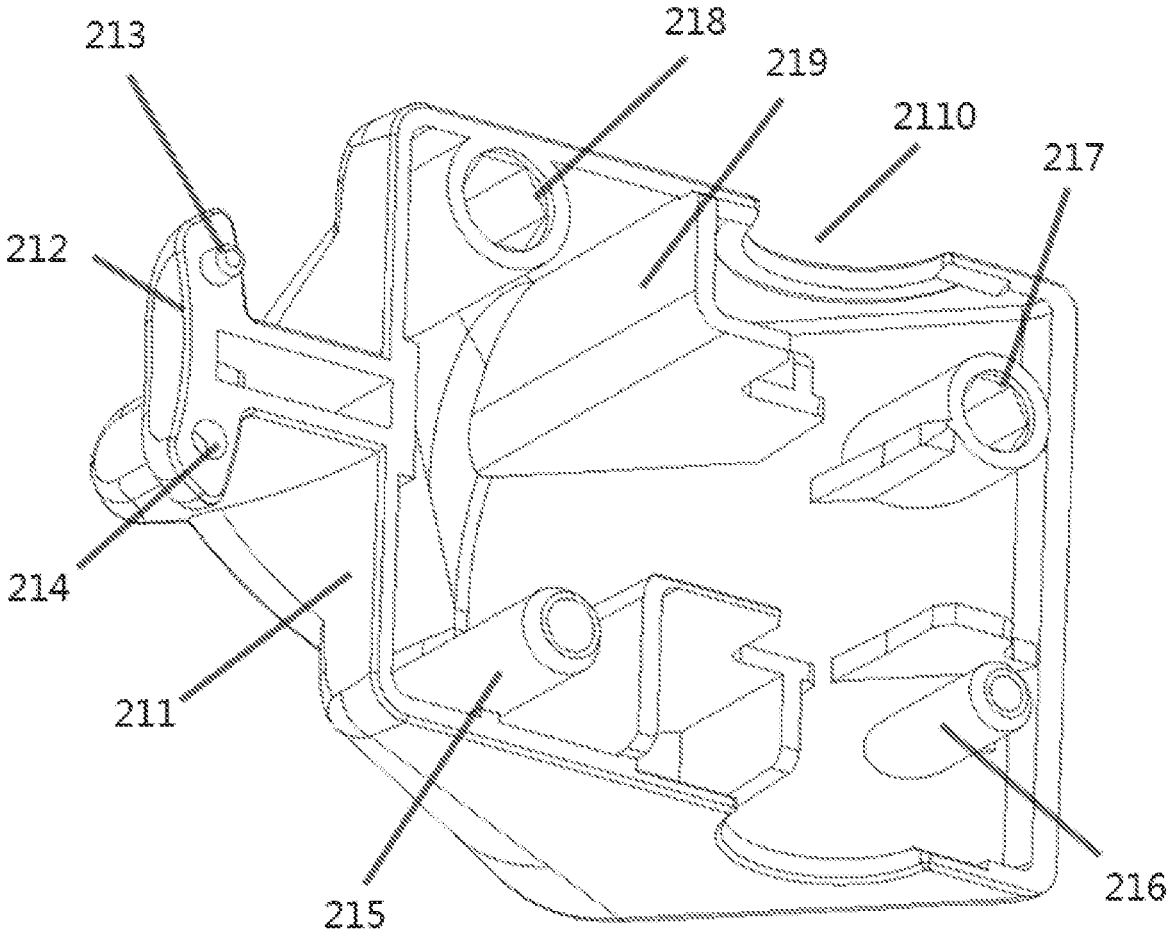
FIG. 14 is an exploded schematic diagram showing an interior of a left half shell of the edge block of the edge block of the present disclosure.
Figure 15:
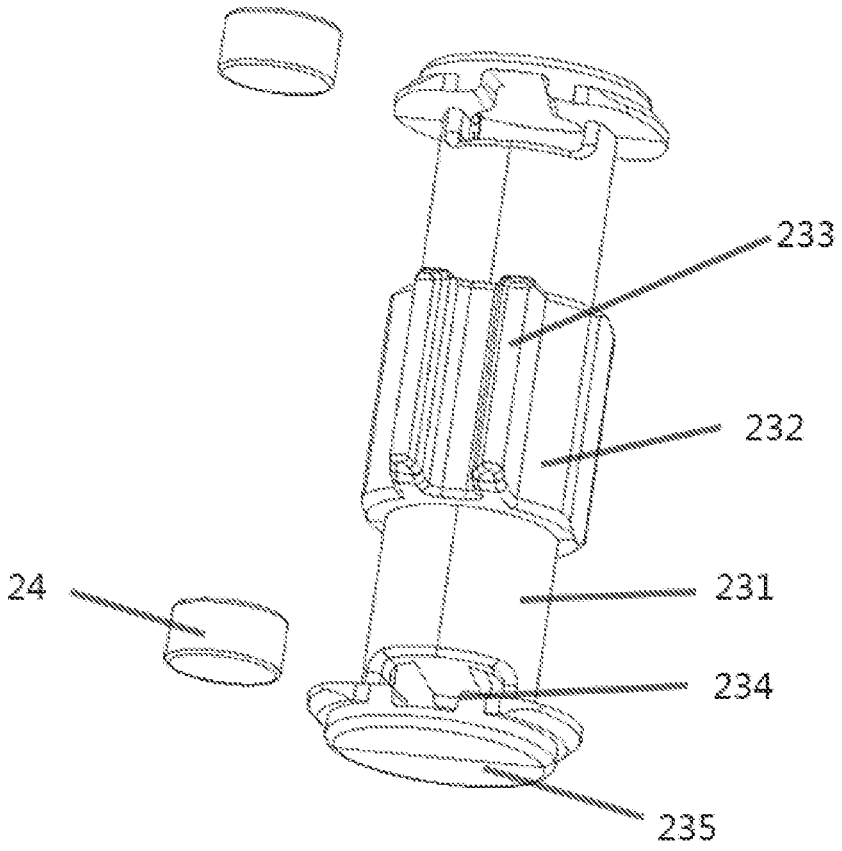
FIG. 15 is a perspective schematic diagram of an edge block magnetic cabin assembly of the present disclosure.

As shown in FIGS. 4 and 5 each of the central blocks 3 comprises a top cover 31, a gear adjusting seat 32, a gear adjusting piece 34, an elastic adjusting screw 35, and a pressure adjusting spring 36. Each top cover 31 covers a top portion of a corresponding gear adjusting seat 32. Each gear adjusting piece 34 is arranged above a corresponding gear adjusting seat 32. A bottom portion of each elastic adjusting screw 35 vertically pass through a corresponding gear adjusting piece 34 and a corresponding gear adjusting seat 32 and is connected with the central shaft piece 4. Each pressure adjusting spring 36 is sleeved between a corresponding elastic adjusting screw 35 and a corresponding gear adjusting piece 34. A top portion of each pressure adjusting spring 36 contacts a screw head of the corresponding elastic adjusting screw 35, and a bottom portion of each pressure adjusting spring 36 contacts an inner bottom portion of the corresponding gear adjusting piece 34, and the bottom of the pressure adjusting spring 36 is in contact with the bottom inner ring of the gear adjusting piece 34. A gasket 37 is arranged between each pressure adjusting spring 36 and the corresponding gear adjusting piece 34. By arrangement of each gasket 37, stable contact between each pressure adjusting spring 36 and the corresponding gear adjusting piece 34 is enhanced.

Each gear adjusting seat 32 comprises an adjusting seat body 321. A central column 322 is arranged in a center of each adjusting seat body 321. A central hole penetrating each central column 322 is on a center of each central column 322. A sawtooth gear block 323 is arranged on a periphery of each central column 322. A gear indicating ring 324 is arranged on a periphery of each sawtooth gear block 323. Gear numbers 325 corresponding to each sawtooth gear block 323 are on each gear indicating ring 324.

During actual assembly, each elastic adjusting screw 35 vertically passes through a corresponding central hole of a corresponding central column 322 and is inserted into the central shaft piece 4. The bottom portion of each elastic adjusting screw 35 is connected with the central shaft piece 4 by threads.

By sawtooth portion with different heights, each sawtooth gear block 323 cooperates with a corresponding gear adjusting piece 34 to adjust a height of a corresponding pressure adjusting spring 36, so as to realize pressure adjustment of each pressure adjusting spring 36. When adjusting, a gear of pressure of each pressure adjusting spring 36 is intuitively indicated by the gear numbers 325 on each gear indicating ring 324, which is convenient for a user to operate. A plurality of hand-locking grooves 326 are provided on a top portion of each adjusting seat body 321, which provide a position for disassembly of a corresponding top cover 31.

Each gear adjusting piece 34 comprises an adjusting piece body 341. A sawtooth adjusting portion 342 is arranged on a bottom potion of each adjusting piece body 341. Each sawtooth adjusting portion 342 is engaged with a corresponding sawtooth gear block 323 of a corresponding gear adjusting seat 32. Two gear adjusting dials 343 upwardly protruded are symmetrically arranged on a top portion of each adjusting piece body 341. A gear indicating arrow 344 configured to indicate a gear is arranged on the top portion of each adjusting piece body 341. Each gear indicating arrow 344 is arranged between each two gear adjusting dials 343. During actual assembly, by cooperation between each sawtooth adjusting portion 342 arranged the bottom portion of each adjusting piece body 341 and each sawtooth gear block 323 arranged in each gear adjusting seat 32, when each adjusting piece body 341 is twisted, each sawtooth adjusting portion 342 cooperates with a corresponding sawtooth gear block 323 to compress each pressure adjusting spring 36 to adjust a height of each pressure adjusting spring 36, so as to realize the pressure adjustment of each pressure adjusting spring 36. By arrangement of the gear adjusting dials 343 that are raised, it is convenient for the user to toggle each gear adjusting piece 34. By cooperation of each gear indicating arrow 344 and a corresponding gear numbers 325 arranged on the gear indicating ring 324, when each gear adjusting piece 34 is twisted, the gear of each pressure adjusting spring 36 is specifically handled.

Each top cover 31 comprises a top cover body 311. A plurality of alignment grooves 312 matched with a corresponding gear adjusting seat are arranged on a bottom portion of each top cover body 311. A plurality of snapping blocks 313 docking with a corresponding gear adjusting seat are arranged on a side wall of the bottom portion of each top cover body 311. Each top cover 31 is configured to protect components arranged in a corresponding gear adjusting seat 32. Each top cover 31 is connected with the corresponding gear adjusting seat 32 through alignment grooves 312 and the snapping blocks 313, so as to facilitate quick assembly and disassembly of each top cover 31.

In the embodiment, by arranging one gear adjusting piece 34 arranged in each of the central blocks 3, different degrees of elastic compression of each pressure adjustment spring 36 are realized by twisting each gear adjusting piece 34, which greatly facilitates adjustment of the elastic force. In actual adjustment, by twisting each gear adjusting piece 34 and by cooperation between each gear adjusting piece 34 and the corresponding gear adjusting seat 32, different degrees of elastic compression of each pressure adjustment spring 36 are realized. By adjusting pressure of each pressure adjusting spring 36, docking pressure and wheelbase between the corresponding gear adjusting seat 32 and the central shaft piece 4 is adjusted, thereby changing a torque when the magic cube is twisted. The greater the docking pressure between each gear adjusting seat 32 and the central shaft piece 4, the greater the torque required when the magic cube is twisted, and the smaller the docking pressure between each gear adjusting seat 32 and the central shaft piece 4, the smaller the torque required when the magic cube is twisted. The user is able to quickly adjust the torque to suit his own preferences, which improves user experience.

As shown in FIGS. 6-11, each of the corner blocks 1 comprises three corner block seats 11 with a same structure and spliced with each other. Each of the corner block seats 11 comprises an outer shell 111. Each outer shell 111 comprises a splicing alignment seat 113 inwardly protruded. The splicing alignment seats 113 are configured to limit a position of the corner block seats 11 when they are spliced together. Corner block magnetic cabin grooves 112 are provided on edges of a docking end of each outer shell 111. During actual assembly, each of the corner block magnetic cabins 1212 is received in a corresponding corner block magnetic cabin groove 112. After each of the corner block magnetic cabins 1212 is received in the corresponding corner block magnetic cabin groove 112, a position of each of the corner block magnetic cabins 1212 is ensured to be stable.

Magnet fixing piece grooves 114 are provided in each outer casing 111. The magnet fixing piece grooves 114 are engaged with the corner block docking seats 1222 of each magnet fixing assembly 122 to ensure that each magnet fixing piece 122 is stably connected to a corresponding outer shell 111. A corner block foot 115 is integrally formed on a bottom portion of each outer shell 111, which facilitates the movable connection between the edge blocks 2 and the central blocks 3.

A magnet fixing device 12 is installed between the three corner block seats 11 of each of the corner blocks. Each magnet fixing device 12 comprises a corner block magnetic cabin assembly 121 and a magnet fixing assembly 122. Each magnet fixing assembly 122 is stacked and installed in a corresponding corner block magnetic cabin assembly 121. Each corner block magnetic cabin assembly 121 comprises a corner block magnetic cabin seat 1211 with a shape of an equilateral triangle. Each corner block magnetic cabin seat 1211 comprises end corners. Each of the corner block magnetic cabins 1212 is arranged on a corresponding end corner. Each magnet 13 is arranged in each of the corner block magnetic cabins 1212. A center of each corner block magnetic cabin seat 1211 defines a first central alignment hole 1214. Three clamping holes 1213 distributed in an equilateral triangle are on a periphery of each first central alignment hole 1214. Each three corner block magnetic cabin seats 1211 distributed in the equilateral triangular are corresponding to three inner sides of each three corner block seats 11 when the three corner block seats 11 of each corner block are spliced together. Each magnet 13 is arranged each inner side, which is beneficial to magnetic adsorption and quick positioning between the corner blocks 1, the edge blocks 2, and the central blocks 3. Each of the corner block magnetic cabins 1212 is a transparent visible corner block magnetic cabin, which is convenient to observe a working state of the magnet in each corner block magnetic cabin 1212.

Each magnet fixing assembly 122 comprises a fixing seat body 1221. Each fixing seat body 1221 comprises three magnet pressing seats 1223 corresponding to the three corner block magnetic cabins 1222 of each corner block magnetic cabin assembly. A corner block docking seat 1222 is arranged on one side of each of the magnet pressing seats 1223. Each fixing seat body 1221 is engaged with the three magnet fixing piece grooves 114 of each of the corner block seats 11 through the three corner block docking seats 1222 of each fixing eat body. Three clamping posts 1224 matched with the clamping holes 1213 on each corner block magnetic cabin seat 1211 are arranged on a bottom portion of each fixing seat body 1221. Each fixing seat body 1221 is docked with each corner block magnetic cabin seat 1211 through the clamping holes 1213 and the clamping posts 1224.

During actual assembly, by inserting the clamping posts 1224 arranged on the bottom portion of each fixing seat body 1221 into the clamping holes 1213 on each corner block magnetic cabin seat 1211, each magnet fixing assembly 121 is stacked on and engaged with the corresponding corner block magnetic cabin assembly 122, which is very convenient to assembly. After the assembly is completed, each magnet pressing seat 1223 directly press the magnet 13 arranged in the corresponding corner block magnetic cabin 1212 to ensure that a position of the magnet 13 is stable. A center of each fixing seat body 1221 defines a second central alignment hole 12226 matched with the first central alignment hole 1214 of each corner block magnetic cabin seat 1211. Three corner block docking holes 1225 are on a periphery of each second central alignment hole 1226 and are connected with a corresponding corner block seat 11. Through alignment between each first central alignment hole 1214 and a corresponding second central alignment hole 1226, alignment between each magnet fixing assembly 122 and the corresponding corner block magnetic cabin assembly 121 is quickly realized.

In the embodiment, by setting one magnet fixing device 12 in each of the corner blocks 1, stable magnet installation positions for three inner sides of each of the corner blocks 1 are provided, which improves assembly accuracy of the magnets, and ensures that the magnets will not fall off or offset during use.

During the actual assembly, it is only necessary to place each three corner block magnets 11 in the three corner block magnetic cabins 1212 on each corner block magnetic cabin assembly 121, and then press the magnet pressing seats 1223 correspondingly provided on each magnet fixing assembly 122 to tightly press the corner block magnets 11. Then each magnet fixing device 12 composed of the corner block magnetic cabin assembly 121 and the magnet fixing assembly 122 is clamped in corresponding three corner block seats 11, which make the assembly simple. By setting one magnet fixing device 12 in each of the corner blocks 1, stable magnet installation positions for three inner sides of each of the corner blocks 1 are provided, which improves assembly accuracy of the magnets, and ensures that the magnets will not fall off or offset during use. Further, there is no need to paste the corner block magnets on inner walls of the corner blocks by chemical substances such as glue, which is safe and environmentally friendly. Each of the corner block magnetic cabins 1212 is a transparent visible corner block magnetic cabin, which is convenient for observing the working state of the magnets in the corner block magnetic cabins 1212.

As shown in FIGS. 12-15, each of the edge block 2 comprises a left half shell of the edge block 21, a right half shell of the edge block 22, and an edge block magnetic cabin assembly 23. Each edge block magnetic cabin assembly 23 is clamped between a corresponding left half shell of the edge block 21 and a corresponding right half shell of the edge block 22. Each left haft half shell 21 and a corresponding right half shell of the edge block 22 are symmetrically arranged and are connected with each other. A structure of each left half shell of the edge block 21 is same as a structure of each right half shell of the edge block 22. Each left half shell of the edge block 21 and each right half shell of the edge block 22 comprise a shell body 211. An engaging foot 212 is integrally formed on a bottom portion of each shell body 211. Engaging foot docking posts 213 and engaging foot docking holes 214 are on inner sides of each shell body 211. When each left half shell of the edge block 21 is docked with the corresponding right half shell of the edge block 22, the engaging foot docking posts 213 of each shell body are inserted into corresponding engaging foot shell docking holes 214, which facilitate stable and fast assembly between the engaging feet 212. A first shell docking post 215, a second housing docking post 216, a first shell docking hole 217 and a second shell docking hole 218 are respectively arranged on four end corners of an inner side of each shell body 211. When each left half shell of the edge block 21 is docked with the corresponding right half shell of the edge block 22, the first shell docking posts 215 and second shell docking posts 216 of the two shell bodies are respectively inserted into the corresponding first shell docking holes 217 and the second shell docking holes 218 of the two shell bodies, which facilitate the quick assembly and disassembly between each left half shell of the edge block 21 and the corresponding right half shell of the edge block 22.

Each edge block magnetic cabin assembly 23 comprises a horizontal strut 231. Edge block magnetic cabins 234 are arranged on left and right ends of each horizontal strut 231. A magnetic piece 24 is arranged in each of the edge block magnetic cabins 234. In the embodiment, each magnetic piece 24 is a magnet. A transparent end cover 235 is arranged on an outer end side of each of the edge block magnetic cabins 234. Each transparent end cover is openable. Each transparent end cover 235 is provided to facilitate the assembly of the magnetic piece 24 in each edge of the block magnetic cabins 234, and to see the position and state of the magnetic piece 24 in each of the edge block magnetic cabins 234, so that the entire magnetic piece 24 is visualized. A limit docking block 232 is arranged on a middle portion of each horizontal strut 231. clipping block 233 are outwardly protruded fem ftm front and rear end surfaces of each limit docking block 232. Each horizontal strut 231 is docked with a corresponding left half shell of the edge block 21 and a corresponding right half shell of the edge block 22 through the clipping blocks 233 arranged on each limit docking block 232, which not only facilitates the quick clamping of each horizontal strut 231 during assembly, but also ensures a stable installation position of each horizontal struts 231 in the corresponding left half shell of the edge block 21 and the corresponding right half shell of the edge block 22. Limit seats 219 matched with the limit docking blocks 232 of each horizontal strut 231 is arranged in each shell body. The limit docking blocks 232 of each horizontal strut are clamped in the limit seats 219 of each edge block magnetic cabin assembly. Edge block magnetic cabin grooves 2110 matched with the edge block magnetic cabins arranged on each horizontal strut are provided on end edges of each shell body 211. The edge block magnetic cabins 234 are clamped in corresponding edge block magnetic cabin grooves 2110 to ensure stable installation positions of the edge block magnetic cabins 234 and the horizontal struts 231.

In the embodiment, by arranging one edge block magnetic cabin assembly 23 in each of the edge blocks; stability of installation positions of the magnetic pieces 24 are ensured, assembly accuracy of the magnetic pieces is improved, and the magnetic pieces 24 will not fall off or offset during use. Each left half shell of the edge block 21 and the corresponding right half shell of the edge block 22 are engaged with each other, which is beneficial to the assembly and disassembly between each left half shell of the edge block 21 and the corresponding right half shell of the edge block 22. Meanwhile, each edge block magnetic cabin assembly 23 is clamped between each left half shell of the edge block 21 and the corresponding right half shell of the edge block 22, and each magnetic piece is placed in a corresponding special edge block magnetic cabin 234 arranged in each edge block magnetic cabin assembly 23, so stability of installation positions of the magnetic pieces 24 are ensured, assembly accuracy of the magnetic pieces is improved, and the magnetic pieces will not fall off or offset during use. Further, there is no need to paste the magnetic pieces 24 on inner walls of the edge blocks by chemical substances such as glue, which is safe and environmentally friendly. In addition, each of the edge block magnetic cabins 234 is transparent, and the position and state of the magnetic pieces 24 arranged in each of the edge block magnetic cabins 234 is visible.

The above are only optional embodiments of the present disclosure, and the present disclosure should not be limited to the contents disclosed in the embodiments and the accompanying drawings. Any equivalents or modifications accomplished without departing from the spirit disclosed in the present disclosure are all fall within the protection scope of the present disclosure.

What is claimed is:

1. A magic cube with visible magnetic cabins, comprising:

a central shaft piece;

six central blocks;

eight corner blocks; and twelve edge blocks;

wherein the six central blocks are separately connected with an end shaft of the central shaft piece; each of the central blocks is movably connected with adjacent corners blocks and edge blocks through corner block feet arranged on the corner blocks and engaging feet arranged on the edge blocks; the central shaft piece is spliced with the six central blocks, the eight corner blocks, and the twelve edge blocks to form a regular hexahedron;

corner block magnetic cabins are arranged on inner sides of the corner blocks and edge block magnetic cabins are arranged on inner sides of the edge blocks; a magnet is arranged in each of the corner block magnetic cabins; a magnet piece is arranged in each of the edge block magnetic cabins; elastic force between the six central blocks and the central shaft piece is adjusted by a gear adjusting piece arranged in each of the central blocks;

wherein each of the corner blocks comprises three corner block seats with a same structure and spliced with each other; a magnet fixing device is installed between the three corner block seats of each of the corner blocks; each magnet fixing device comprises a corner block magnetic cabin assembly and a magnet fixing assembly: each magnet fixing assembly is stacked and installed in a corresponding corner block magnetic cabin assembly; each corner block magnetic cabin assembly comprises three corner block magnetic cabins; the three corner block magnetic cabins of each corner block magnetic cabin assembly are respectively clamped at joints of end edges of the three corner block seats of each of the corner blocks; the magnet is installed in each of the corner block magnetic cabins; each magnet is tightly pressed by a magnet pressing seat correspondingly arranged on a corresponding magnet fixing assembly, the corner block magnetic cabins are transparent visible corner block magnetic cabins.

2. The magic cube with visible magnetic cabins according to claim 1, wherein each of the central blocks comprises a top cover, a gear adjusting seat, the gear adjusting piece, an elastic adjusting screw, and a pressure adjusting spring; each top cover covers a top portion of a corresponding gear adjusting seat; each gear adjusting piece is arranged above a corresponding gear adjusting seat; a bottom portion of each elastic adjusting screw vertically pass through a corresponding gear adjusting piece and a corresponding gear adjusting seat and is connected with the central shaft piece; each pressure adjusting spring is sleeved between a corresponding elastic adjusting screw and a corresponding gear adjusting piece.

3. The magic cube with visible magnetic cabins according to claim 2, wherein each gear adjusting seat comprises an adjusting seat body, a central column is arranged in a center of each adjusting seat body; a central hole penetrating each central column is on a center of each central column; a sawtooth gear block is arranged on a periphery of each central column; a gear indicating ring is arranged on a periphery of each sawtooth gear block; gear numbers corresponding to each sawtooth gear block are on each gear indicating ring.

4. The magic cube with visible magnetic cabins according to claim 3, wherein each gear adjusting piece comprises an adjusting piece body, a sawtooth adjusting portion is arranged on a bottom potion of each adjusting piece body; each sawtooth adjusting portion is engaged with a corresponding sawtooth gear block of a corresponding gear adjusting seat; two gear adjusting dials upwardly protruded are symmetrically arranged on a top portion of each adjusting piece body; a gear indicating arrow configured to indicate a gear is arranged on the top portion of each adjusting piece body; each gear indicating arrow is arranged between each two gear adjusting dials.

5. The magic cube with visible magnetic cabins according to claim 4, wherein each top cover is arranged on a top portion of each gear adjusting seat; each top cover is openable and closable; each top cover comprises a top cover body; a plurality of alignment grooves matched with a corresponding gear adjusting seat are arranged on a bottom portion of each top cover body; a plurality of snapping blocks docking with a corresponding gear adjusting seat are arranged on a side wall of the bottom portion of each top cover body.

6. The magic cube with visible magnetic cabins according to claim 1, wherein each corner block magnetic cabin assembly comprises a corner block magnetic cabin seat with a shape of an equilateral triangle; each corner block magnetic cabin seat comprises end corners; each of the corner block magnetic cabins is arranged on a corresponding end corner; a center of each corner block magnetic cabin seat defines a first central alignment hole; a plurality of clamping holes are on a periphery of each first central alignment hole;

wherein each magnet fixing assembly comprises a fixing seat body; each fixing seat body comprises three magnet pressing seats corresponding to the three corner block magnetic cabins of each corner block magnetic cabin assembly; a corner block docking seat is arranged on one side of each of the magnet pressing seats; each fixing seat body is engaged with the three corner block seats of each corner block through the three corner block docking seats of each fixing eat body; a plurality of clamping posts matched with the clamping holes on each corner block magnetic cabin seat are arranged on a bottom portion of each fixing seat body; each fixing seat body is docked with each corner block magnetic cabin seat through the clamping holes and the clamping posts;

wherein a center of each fixing seat body defines a second central alignment hole matched with the first central alignment hole of each corner block magnetic cabin seat; a plurality of corner block docking holes are on a periphery of each second central alignment hole and are connected with a corresponding corner block seat; and wherein each of the corner block seats comprises an outer shell; each outer shell comprises an splicing alignment seat inwardly protruded; corner block magnetic cabin grooves are provided on edges of a docking end of each outer shell; each of the corner block magnetic cabins is received in a corresponding corner block magnetic cabin groove; and a corner block foot is integrally formed on a bottom portion of each outer shell.

7. The magic cube with visible magnetic cabins according to claim 1, wherein each of the edge block comprises a left half shell of the edge block, a right half shell of the edge block, and an edge block magnetic cabin assembly; wherein each edge block magnetic cabin assembly is clamped between a corresponding left half shell of the edge block and a corresponding right half shell of the edge block; each left half shell and a corresponding right half shell of the edge block are symmetrically arranged and are connected with each other; each edge block magnetic cabin assembly comprises a horizontal strut; edge block magnetic cabins are arranged on left and right ends of each horizontal strut; each magnetic piece is arranged in each of the edge block magnetic cabins; a transparent end cover is arranged on an outer end side of each of the edge block magnetic cabins; each transparent end cover is openable.

8. The magic cube with visible magnetic cabins according to claim 7, wherein a limit docking block is arranged on a middle portion of each horizontal strut; clipping block are outwardly protruded from front and rear end surfaces of each limit docking block; each horizontal strut is docked with a corresponding left half shell of the edge block and a corresponding right half shell of the edge block through the clipping blocks arranged on each limit docking block; a structure of each left half shell of the edge block is same as a structure of each right half shell of the edge block; each left half shell of the edge block and each right half shell of the edge block comprise a shell body; an engaging foot is integrally formed on a bottom portion of each shell body; engaging foot docking posts and engaging foot docking holes are on inner sides of each shell body; when each left half shell of the edge block is docked with the corresponding right half shell of the edge block, the engaging foot docking posts of each shell body are inserted into corresponding engaging foot docking holes.

9. The magic cube with visible magnetic cabins according to claim 8, wherein limit seats matched with the limit docking blocks of each horizontal strut is arranged in each edge block magnetic cabin assembly; the limit docking blocks of each horizontal strut are clamped in the limit seats of each edge block magnetic cabin assembly, edge block magnetic cabin grooves matched with the edge block magnetic cabins arranged on each horizontal strut are provided on end edges of each shell body; the edge block magnetic cabins are clamped in corresponding edge block magnetic cabin grooves.

10. A magic cube with visible magnetic cabins, comprising:

a central shaft piece;

six central blocks;

eight corner blocks; and twelve edge blocks;

wherein the six central blocks are separately connected with an end shaft of the central shaft piece; each of the central blocks is movably connected with adjacent corners blocks and edge blocks through corner block feet arranged on the corner blocks and engaging feet arranged on the edge blocks; the central shaft piece is spliced with the six central blocks, the eight corner blocks, and the twelve edge blocks to form a regular hexahedron;

corner block magnetic cabins are arranged on inner sides of the corner blocks and edge block magnetic cabins are arranged on inner sides of the edge blocks; a magnet is arranged in each of the corner block magnetic cabins; a magnet piece is arranged in each of the edge block magnetic cabins; elastic force between the six central blocks and the central shaft piece is adjusted by a gear adjusting piece arranged in each of the central blocks;

wherein each of the edge block comprises a left half shell of the edge block, a right half shell of the edge block, and an edge block magnetic cabin assembly; wherein each edge block magnetic cabin assembly is clamped between a corresponding left half shell of the edge block and a corresponding right half shell of the edge block; each left half shell and a corresponding right half shell of the edge block are symmetrically arranged and are connected with each other; each edge block magnetic cabin assembly comprises a horizontal strut; edge block magnetic cabins are arranged on left and right ends of each horizontal strut; each magnetic piece is arranged in each of the edge block magnetic cabins; a transparent end cover is arranged on an outer end side of each of the edge block magnetic cabins; each transparent end cover is openable;

wherein a limit docking block is arranged on a middle portion of each horizontal strut; clipping block are outwardly protruded from front and rear end surfaces of each limit docking block; each horizontal strut is docked with a corresponding left half shell of the edge block and a corresponding right half shell of the edge block through the clipping blocks arranged on each limit docking block; a structure of each left half shell of the edge block is same as a structure of each right half shell of the edge block; each left half shell of the edge block and each right half shell of the edge block comprise a shell body; an engaging foot is integrally formed on a bottom portion of each shell body; engaging foot docking posts and engaging foot docking holes are on inner sides of each shell body; when each left half shell of the edge block is docked with the corresponding right half shell of the edge block, the engaging foot docking posts of each shell body are inserted into corresponding engaging foot docking holes.

11. A magic cube with visible magnetic cabins, comprising:

a central shaft piece;

six central blocks;

eight corner blocks; and twelve edge blocks;

wherein the six central blocks are separately connected with an end shaft of the central shaft piece; each of the central blocks is movably connected with adjacent corners blocks and edge blocks through corner block feet arranged on the corner blocks and engaging feet arranged on the edge blocks; the central shaft piece is spliced with the six central blocks, the eight corner blocks, and the twelve edge blocks to form a regular hexahedron;

corner block magnetic cabins are arranged on inner sides of the corner blocks and edge block magnetic cabins are arranged on inner sides of the edge blocks; a magnet is arranged in each of the corner block magnetic cabins; a magnet piece is arranged in each of the edge block magnetic cabins; elastic force between the six central blocks and the central shaft piece is adjusted by a gear adjusting piece arranged in each of the central blocks;

wherein each of the central blocks comprises a top cover, a gear adjusting seat, the gear adjusting piece, an elastic adjusting screw, and a pressure adjusting spring; each top cover covers a top portion of a corresponding gear adjusting seat; each gear adjusting piece is arranged above a corresponding gear adjusting seat; a bottom portion of each elastic adjusting screw vertically pass through a corresponding gear adjusting piece and a corresponding gear adjusting seat and is connected with the central shaft piece; each pressure adjusting spring is sleeved between a corresponding elastic adjusting screw and a corresponding gear adjusting piece;

wherein each top cover is arranged on a top portion of each gear adjusting seat; each top cover is openable and closable; each top cover comprises a top cover body; a plurality of alignment grooves matched with a corresponding gear adjusting seat are arranged on a bottom portion of each top cover body; a plurality of snapping blocks docking with a corresponding gear adjusting seat are arranged on a side wall of the bottom portion of each top cover body.

* * * * *